United States Patent [19]

Sando et al.

[11] 4,277,860

[45] Jul. 14, 1981

[54] METHOD OF HEAT FULLING AND WATER WASHING OF CLOTH

[75] Inventors: Yoshikazu Sando; Hiroshi Ishidoshiro, both of Wakayama, Japan

[73] Assignee: Sando Iron Works Co. Ltd., Tokyo, Japan

[21] Appl. No.: 786,801

[22] Filed: Apr. 12, 1977

Related U.S. Application Data

[60] Division of Ser. No. 628,495, Nov. 3, 1975, abandoned, which is a continuation of Ser. No. 478,749, Jun. 12, 1974, abandoned.

[51] Int. Cl.[3] ..... D06B 3/20

[52] U.S. Cl. ..... 8/151; 8/152

[58] Field of Search ..... 68/43, 44, 62, 148, 68/158, 175, 177, 181 R, 183, 184, 205 R, 207; 26/20, 21; 8/151, 151.2, 152

[56] References Cited

U.S. PATENT DOCUMENTS

| | | | |
|---|---|---|---|
| 3,579,679 | 5/1971 | Willis | 8/151 |
| 3,849,068 | 11/1974 | Meier-Windhorst | 8/151 |

FOREIGN PATENT DOCUMENTS

| | | | |
|---|---|---|---|
| 581070 | 7/1933 | Fed. Rep. of Germany | 68/158 |
| 38-15792 | 8/1963 | Japan | 68/183 |
| 45-18047 | 6/1970 | Japan | 68/175 |

*Primary Examiner*—Philip R. Coe

*Attorney, Agent, or Firm*—Toren, McGeady & Stanger

[57] ABSTRACT

In a method of heat fulling and water washing of cloth, hot fluid is injected onto both surfaces of the cloth from hot fluid injection nozzles in upper and lower rows to sandwich the cloth in such manner that the positions of nozzles in the upper row alternate with those nozzles in the lower row, with the cloth passing through an opening between upper and lower net conveyors so that the cloth is immersed in cleaning liquid, with both a cleansing effect and fulling effect being given to the cloth.

2 Claims, 2 Drawing Figures

METHOD OF HEAT FULLING AND WATER WASHING OF CLOTH

This is a division of application Ser. No. 628,495 filed Nov. 3, 1975, now abandoned, which, in turn, is a continuation of Application Ser. No. 478,749, filed June 12, 1974, now abandoned.

BRIEF SUMMARY OF THE INVENTION

The present invention relates to a hot fulling and water washing apparatus which is characterized by that hot fluid is injected onto both surfaces of cloth from hot fluid injection nozzles placed at upper and lower rows which sandwich the passing path of said cloth in such manner that the positions of the nozzles in the upper row are alternated with those of nozzles in the lower row, in a process of passing the cloth through an opening between upper and lower net conveyors in such state as immersing the cloth in cleaning liquid, so that both cleansing effect and fulling effect are given to the cloth.

Now, the apparatus will be explained by an example shown in the drawings.

DETAILED DESCRIPTION OF THE DRAWING

Figure 1:
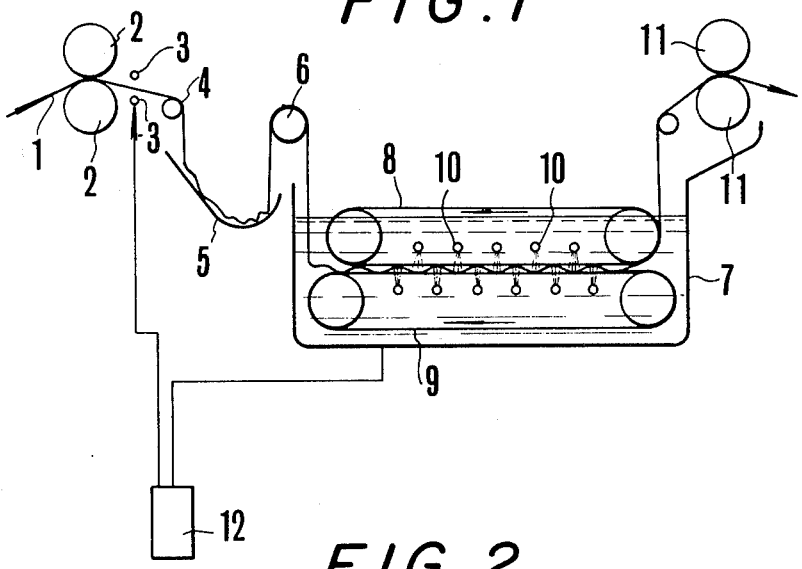
Figure 2:
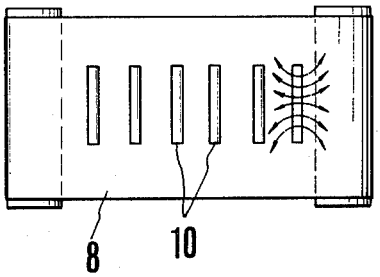

FIG. 1 is a schematic side view of the apparatus of the present invention; and FIG. 2 is a partial plan of the same.

The cloth 1 which has been subjected to scouring, bleaching and other processes is sent through squeezing rolls 2 and is washed by shower water with shower pipes 3, then is stagnated at a piler 5 after going through a guide roll 4.

The cloth 1, which has been stagnated there until the rinsing and fulling processes have been completed, is sent into a water washing tank 7 through a feeder roll 6.

Numerals 8 and 9 are upper and lower net conveyors opposingly provided having a narrow opening therebetween, wherein said conveyors are so positioned that at least the opening is immersed in the liquid in the water washing tank 7.

Pipes 10 which inject fluid (hot water, steam, or hot air) are provided in an alternate manner at upper and lower positions relative to a cloth passing path which is the above mentioned narrow opening, so that hot fluid is injected onto the both surfaces of the cloth.

The cloth will be moved forward with no tension working thereon while it is being struck by the injected fluid and pushed against the upper and lower net conveyors in a waveform, thus water washing and fulling are given to the cloth simultaneously.

At this time if pipes 10 are made shorter than the width of the cloth 1, the cloth will also receive an expanding effect by such jet streams as shown in FIG. 2 (note the directions shown by arrow marks).

Then the cloth 1 is pulled up and is guided out of the water washing tank 7 via squeezing rolls 11.

12 is a purification tank, in which waste water from the water washing tank 7 is purified and then the purified water is resupplied to the shower unit 3.

What is claimed is:

1. A method for cleaning and fulling a cloth, comprising passing the cloth in an untensioned state through an elongated opening formed between a horizontally elongated upper net conveyor and a horizontally elongated lower net conveyor and located within a washing tank filled with cleaning fluid with the vertical spacing of the opening between the conveyors being greater than the thickness of the cloth, spraying hot fluid downwardly through the upper conveyor against the upper surface of the cloth at horizontally spaced positions along the path of travel of the cloth between the conveyors, spraying hot fluid through the lower conveyor upwardly against the lower surface of the cloth at spaced positions different from and alternating with the last mentioned positions for spraying through the upper conveyor into the elongated opening with the spray passing through the upper conveyor into the elongated opening pushing the cloth against the lower conveyor and the spray passing through the lower conveyor into the elongated opening pushing the cloth against the upper conveyor as the cloth moves along the path of travel between the conveyors, and moving the cloth through the elongated opening formed by said pair of conveyors in a wave-like manner, whereby no tension is exerted on the cloth.

2. A method, as set forth in claim 1, including the step of expanding the cloth in the direction transverse to its path of travel between the conveyors by directing the spraying action outwardly toward the opposite edges of the cloth.

* * * * *